US007348480B1

(12) United States Patent
Liao

(10) Patent No.: US 7,348,480 B1
(45) Date of Patent: Mar. 25, 2008

(54) PEDAL OPERATED CYMBAL STAND FOR HOLDING CYMBALS WITH ADJUSTABLE ELEVATION ANGLE AND POSITION

(76) Inventor: Tsun-Chi Liao, 1F, No.7, Lane545, Sec.2, Jyungong Rd., Beitun Dist., Taichung City (TW)

( * ) Notice: Subject to any disclaimer, the term of this patent is extended or adjusted under 35 U.S.C. 154(b) by 0 days.

(21) Appl. No.: 11/599,450

(22) Filed: Nov. 15, 2006

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 6,049,032 A 4/2000 Liao
6,215,056 B1 4/2001 Liao
6,528,714 B1 3/2003 Liao
7,005,568 B2 * 2/2006 Hsieh ..... 84/422.1

FOREIGN PATENT DOCUMENTS

DE 3520837 C1 * 10/1986

* cited by examiner

*Primary Examiner*—Kimberly Lockett
(74) *Attorney, Agent, or Firm*—Birch, Stewart, Kolasch & Birch, LLP

(57) ABSTRACT

A pedal operated cymbal stand includes a foot pedal, a first post, a connection bar, a second post and two spherical joints. The first post is located above the foot pedal. The first post and one end of the connection bar are connected through one spherical joint. The other end of the connection bar and the second post are connected through other spherical joint. The second post holds a pair of cymbals. The spherical joints provide degree of freedom for rotation so that drummers can change the angle of elevation and position of the cymbals to meet individual habits and requirements of different drummers.

10 Claims, 4 Drawing Sheets

PEDAL OPERATED CYMBAL STAND FOR HOLDING CYMBALS WITH ADJUSTABLE ELEVATION ANGLE AND POSITION

FIELD OF THE INVENTION

The present invention relates to a pedal operated cymbal stand and particularly to a pedal operated cymbal stand for holding cymbals with adjustable elevation angle and position to meet different use habits of drummers.

BACKGROUND OF THE INVENTION

In general, music performers, especially the drummers who have to operate many different types of musical instruments, often are surrounded by percussion instruments of varying acoustic effect. Some have a microphone stand or a side drum stand around the drum stand. To achieve versatility during performance the drummers usually have to move hands and feet to strike various types of instruments. Hence aid by a pedal operated cymbal stand driven by foot is required. References of pedal operated cymbal stand are available in U.S. Pat. Nos. 6,049,032, 6,215,056 B1, 6,528,714 B1, etc. They generally have a foot pedal located below the pedal operated cymbal stand to be stepped by a drummer's foot to actuate a pair of cymbals located on the upper side of the stand so that the cymbals strike each other to generate sound as desired.

The present conventional pedal operated cymbal stands allow the elevation angle of the cymbals to be adjusted only slightly. The drummers have to compromise their physical condition to suit the limited operation angle and position during performance. If a drummer wants to move the cymbal stand to a desired angle and position to suit his/her habit to achieve the optimal performance effect, the pedal operated cymbal stand has to be custom-made according to a special specification. It is expensive and cannot meet the requirements of different users.

SUMMARY OF THE INVENTION

Therefore the primary object of the present invention is to provide a pedal operated cymbal stand for holding cymbals with adjustable angle and position to meet different use habits of drummers so that the angle and position of the cymbals can be adjusted as desired to suit the optimal position and habits of individual performers.

The pedal operated cymbal stand according to the invention includes a foot pedal, a first post, a second post, two spherical joints, a connection bar and a linkage means. The two spherical joints have respectively a first distal end and a second distal end. The first distal end has a parallel cross section with degree of freedom for rotation relative to the second distal end, and can receive a force to alter the position relative to the second distal end.

The first post is located above the foot pedal. The second post holds a pair of cymbals. The connection bar has one end connecting to the first distal end of one spherical joint and the first post is connected to the second distal end of the one spherical joint. The connection bar has other end connecting to the first distal end of another spherical joint and the second post is connected to the second distal end of the another spherical joint. The linkage means has one end connecting to the foot pedal and another end connecting to the cymbals. Thus when the foot pedal is stepped, the linkage means can actuate the cymbals to strike each other to generate sound.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
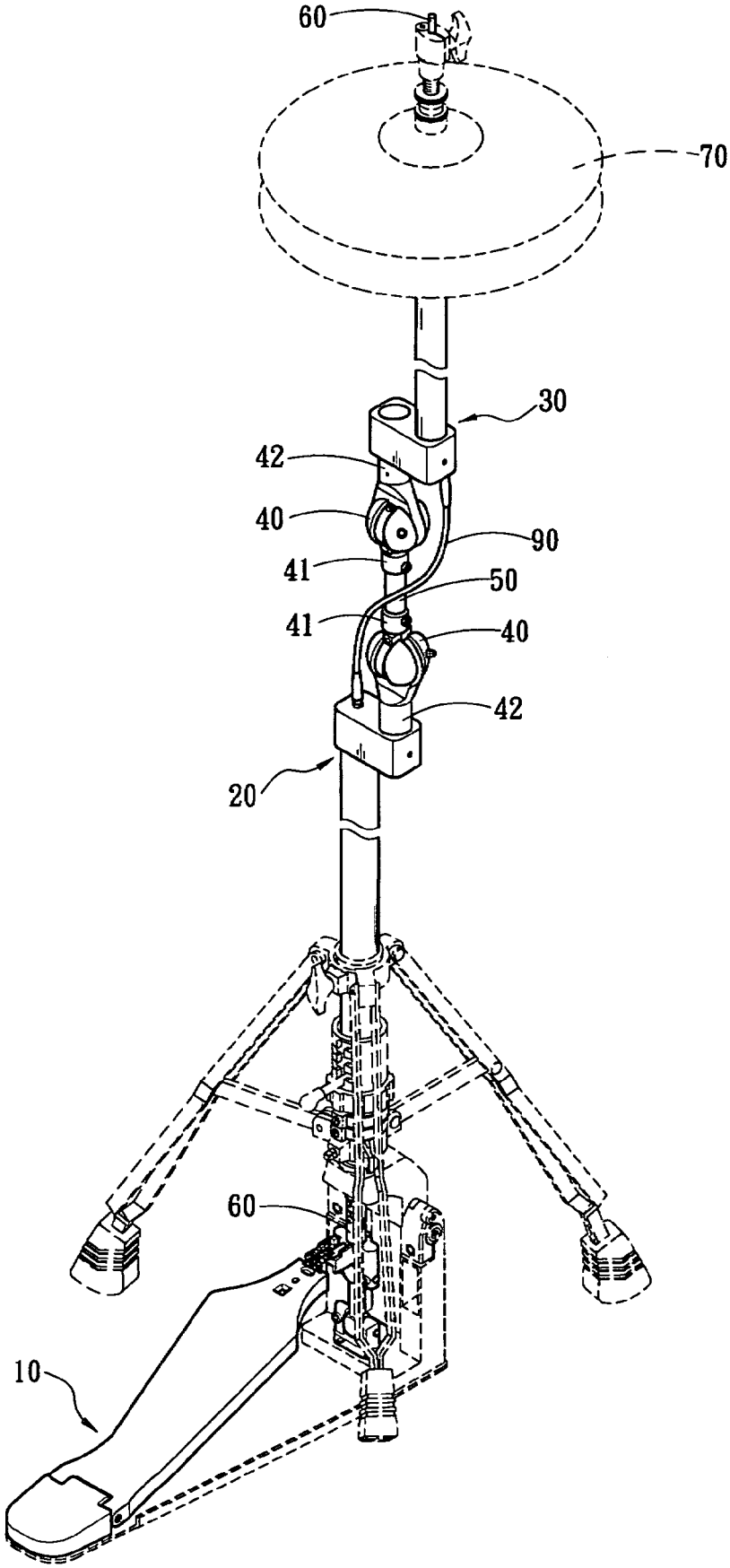
FIG. 1 is a perspective view of the invention.

Please refer to FIG. 1, the invention includes a foot pedal 10, a first post 20, a second post 30, two spherical joints 40, a connection bar 50 and a linkage means 60. Each of the two spherical joints 40 has a first distal end 41 and a second distal end 42. The first distal end 41 has a degree of freedom for rotation relative to the second distal end 42 about a parallel cross section, and can receive a force to alter the relative position with the second distal end 42.

The first post 20 is located above the foot pedal 10. The second post 30 holds a pair of cymbals 70. The connection bar 50 has one end connecting to the first distal end 41 of one spherical joint 40 and the first post 20 is connected to the second distal end 42 of the one spherical joint 40. The connection bar 50 has other end connecting to the first distal end 41 of another spherical joint 40 and the second post 30 is connected to the second distal end 42 of the another spherical joint 40.

The linkage means 60 has one end connecting to the foot pedal 10 and another end connecting to the cymbals 70. Thus when the foot pedal 10 is stepped, the linkage means 60 can actuate the cymbals 70 to strike each other to generate sound.

Figure 2:
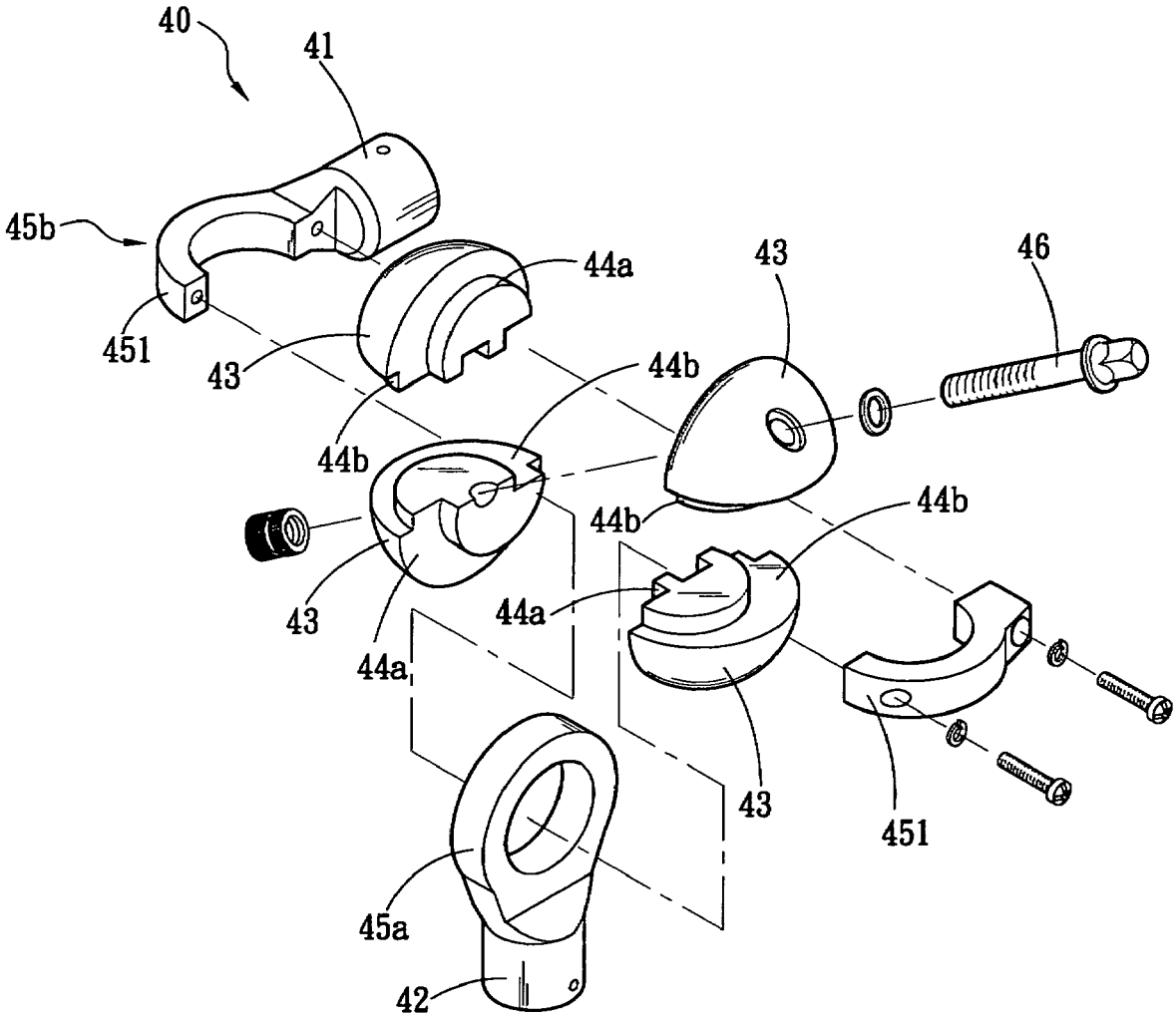
FIG. 2 is an exploded view of a spherical joint of the invention.

Referring to FIG. 2, each of the spherical joins 40 includes four quarter spherical elements 43 to jointly form a sphere. The surface of the sphere has a first annular troughs 44*a* and a second annular trough 44*b* crossing each other in a normal manner. The first annular trough 44*a* is coupled with a first circular ring 45*a* to form the sphere. The second annular trough 44*b* is coupled with a second circular ring 45*b*. The second circular ring 45*b* consisting of two half rings 451 fastened together by screwing. The two circular rings 45*a* and 45*b* have respectively one end extended outwards to form the first distal end 41 and the second distal end 42 to be fastened to the first post 20, second post 30 and connection bar 50.

Among the four quarter spherical elements 43, two in the diagonal location are fastened together through a screw fastening element 46. The fastening tightness of the fastening element 46 can be adjusted to alter the tightness of the spherical joint 40. Namely, the force required to alter the relative position of the first distal end 41 and the second distal end 42 can be changed as desired.

Figure 3:
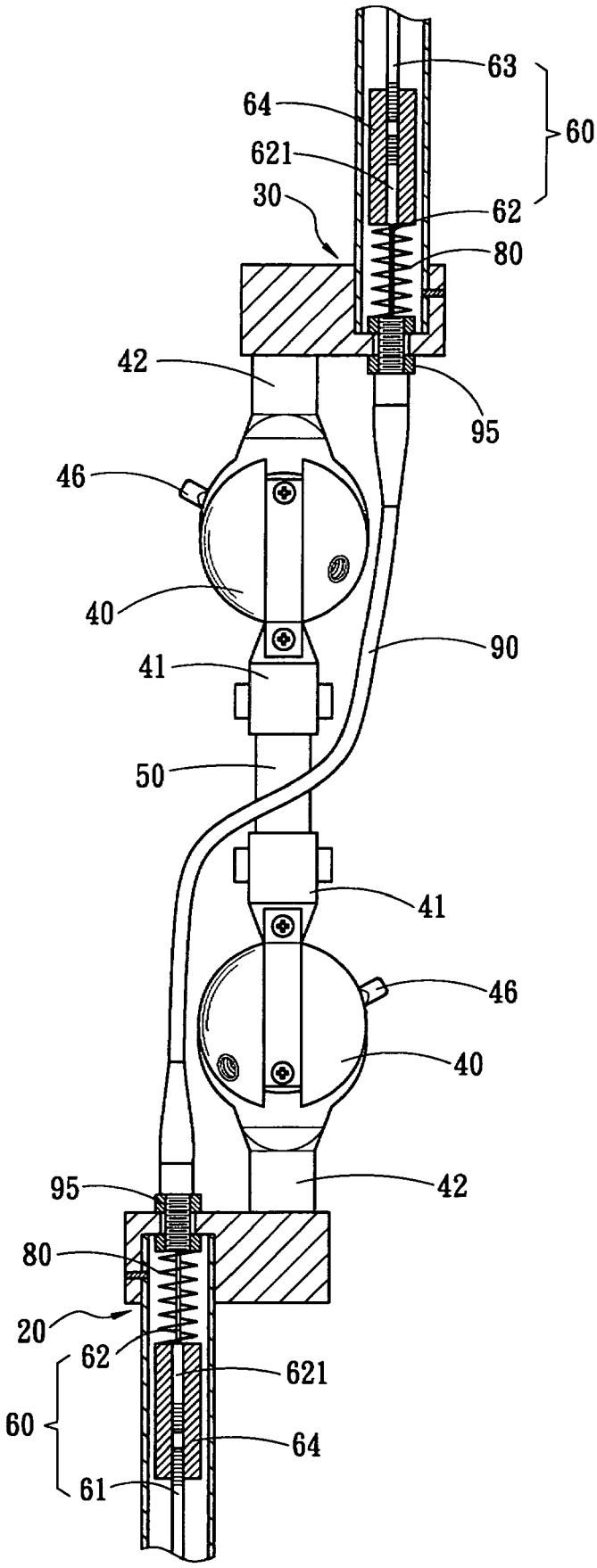
FIG. 3 is a fragmentary sectional view of the invention.

Referring to FIG. 3, the linkage means 60 includes a first drawing bar 61, a drawing cord 62 and a second drawing bar 63. The first drawing bar 61 and the second drawing bar 63 are located respectively in the first post 20 and the second post 30. The first drawing bar 61 is connected to the foot pedal 10. The second drawing bar 63 is connected to an upper cymbal of the cymbals 70. The drawing cord 62 has two ends fastened to the first drawing bar 61 and the second drawing bar 63. Each of the two ends of the drawing cord 62 has a fastening strut 621 with screw threads formed on a distal end thereof. The first drawing bar 61 and the second drawing bar 63 have respectively one end with screw threads formed thereon. The fastening strut 621, first drawing bar 61 and second drawing bar 63 have respectively one end fastened by a nut 64 which has internal screw threads. There is a returning spring 80 located between the first drawing bar 61 and the first post 20 to keep them at a fixed relative position. Similarly, another returning spring 80 is located between the second drawing bar 63 and the second post 30 to keep them at a fixed relative position to return the linkage means 60 to an original condition.

The drawing cord 62 may be a steel cable, and is located between the first post 20 and the second post 30. It also may be encased in a rubber sleeve 90 which has two ends fastened to one end of the first post 20 and second post 30 through a fastening portion 95 to anchor the rubber sleeve 90.

Figure 4:
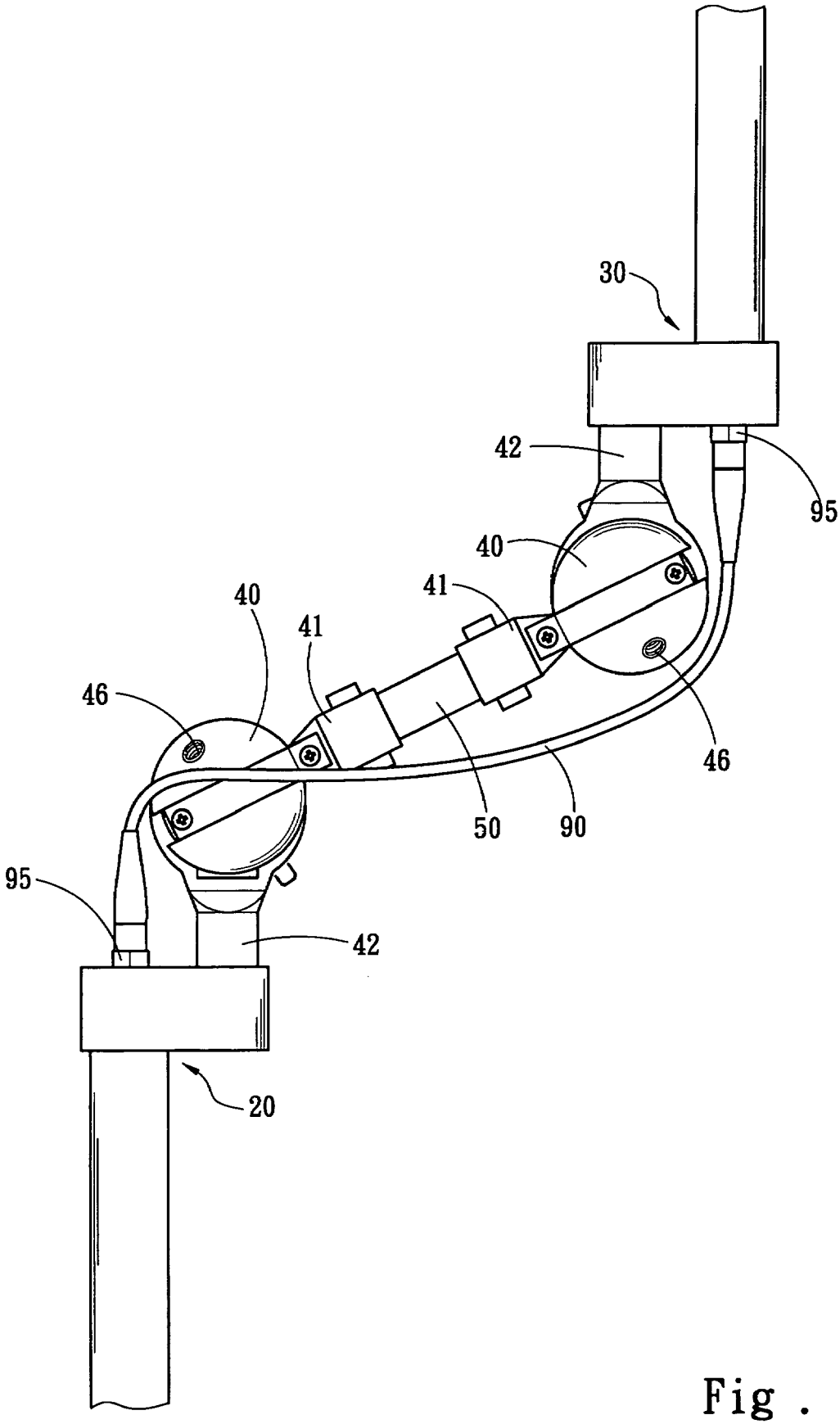
FIG. 4 is a fragmentary schematic view of the invention with the first post and the second post in a condition of altering position.

Refer to FIG. 4, as the two spherical joints 40 can be rotated, the relative position of the first post 20 and the second post 30 can be changed according to the desire and habits of drummers. Hence the cymbals 70 on the second post 30 can be moved to required positions to suit the individual need of the drummers to achieve optimal performance effect.

What is claimed is:

1. A pedal operated cymbal stand for holding a pair of cymbals whose angle and position are adjustable, comprising:

a foot pedal;

a first post located above the foot pedal;

a second post for holding the cymbals;

two spherical joints which have respectively a first distal end and a second distal end, the first distal end having a degree of freedom for rotation relative to the second distal end about a parallel cross section and forming a relative position with the second distal end that is changeable when subject to a force;

a connection bar which has one end connecting to the first distal end of one spherical joint and other end connecting to the first distal end of another spherical joint, the first post being connected to the second distal end of the one spherical joint, the second post being connected to the second distal end of the another spherical joint; and a linkage means which has one end connecting to the foot pedal and another end connecting to the cymbals such that when the foot pedal is stepped the cymbals are driven by the linkage means to strike each other.

2. The pedal operated cymbal stand of claim 1, wherein each of the spherical joints includes four quarter spherical elements which jointly form a sphere, the surface of the sphere having two annular troughs crossing each other in a normal manner, one annular trough being coupled with a first circular ring to form the sphere, another annular trough being coupled with a second circular ring, the two circular rings having respectively one end extended to form the first distal end and the second distal end.

3. The pedal operated cymbal stand of claim 2, wherein the second circular ring includes two half circular rings fastened together by screwing.

4. The pedal operated cymbal stand of claim 2, wherein two of the four quarter spherical elements in the diagonal position are fastened together through a screw fastening element.

5. The pedal operated cymbal stand of claim 1, wherein the linkage means includes a first drawing bar, a drawing cord and a second drawing bar, the first drawing bar and the second drawing bar being located respectively in the first post and the second post, the first drawing bar being fastened to the foot pedal, the second drawing bar being connected to a upper cymbal of the cymbals, the drawing cord having two ends fastened to the first drawing bar and the second drawing bar.

6. The pedal operated cymbal stand of claim 5, wherein each of the two ends of the drawing cord has a fastening strut which has a distal end formed with screw threads, the first drawing bar and the second drawing bar having respectively one end which has screw threads formed thereon, the fastening strut, the first drawing bar and the second drawing bar having respectively the one end fastened to a nut which has internal screw threads formed thereon.

7. The pedal operated cymbal stand of claim 5, wherein the first drawing bar and the first post are interposed by a returning spring at desired relative positions.

8. The pedal operated cymbal stand of claim 5, wherein the second drawing bar and the second post are interposed by another returning spring at desired relative positions.

9. The pedal operated cymbal stand of claim 5, wherein the drawing cord is a steel cable located between the first post and the second post, and encased in a rubber sleeve.

10. The pedal operated cymbal stand of claim 9, wherein the rubber sleeve has two ends connected respectively to a fastening portion which is fastened respectively to one end of the first post and the second post.

* * * * *